US005819476A

United States Patent [19]

Annestedt, Sr.

[11] Patent Number: 5,819,476

[45] Date of Patent: Oct. 13, 1998

[54] GUTTER COVER MOUNTING CLIPS

[75] Inventor: James William Annestedt, Sr., Germantown, Tenn.

[73] Assignee: American Metal Products Co., Olive Branch, Miss.

[21] Appl. No.: 903,522

[22] Filed: Jul. 30, 1997

[51] Int. Cl.[6] ..... E04D 13/064

[52] U.S. Cl. ..... 52/11; 52/15; 24/457

[58] Field of Search ..... 52/11, 12, 15; 24/457, 531, 529; 248/74.1, 48.1, 48.2

[56] References Cited

U.S. PATENT DOCUMENTS

| | | |
|---|---|---|
| 3,225,407 | 12/1965 | Daniels . |
| 3,351,206 | 11/1967 | Wennerstrom . |
| 3,420,378 | 1/1969 | Turner . |
| 4,036,761 | 7/1977 | Rankin . |
| 4,307,976 | 12/1981 | Butler . |
| 4,601,451 | 7/1986 | Leonardo . |
| 4,783,029 | 11/1988 | Geppert . |
| 5,095,666 | 3/1992 | Williams, Jr. . |
| 5,230,798 | 7/1993 | Rogman . |
| 5,251,410 | 10/1993 | Carey . |
| 5,257,482 | 11/1993 | Sichel . |
| 5,271,191 | 12/1993 | Vahamaki . |
| 5,271,192 | 12/1993 | Nothum, Sr. et al. . |
| 5,302,283 | 4/1994 | Meuche . |
| 5,305,562 | 4/1994 | Sapia . |
| 5,321,920 | 6/1994 | Sichel . |
| 5,339,575 | 8/1994 | Kuhns . |
| 5,375,379 | 12/1994 | Meckstroth . |
| 5,383,310 | 1/1995 | Sapia . |
| 5,395,079 | 3/1995 | Jensen et al. . |
| 5,398,464 | 3/1995 | Jacobs . |
| 5,406,754 | 4/1995 | Cosby . |
| 5,406,755 | 4/1995 | Serano . |
| 5,435,105 | 7/1995 | Visser . |
| 5,438,803 | 8/1995 | Blizard, Jr. . |
| 5,457,916 | 10/1995 | Tenute . |
| 5,459,965 | 10/1995 | Meckstroth . |
| 5,471,798 | 12/1995 | Kuhns . |
| 5,491,998 | 2/1996 | Hansen . |
| 5,495,694 | 3/1996 | Kuhns . |
| 5,522,183 | 6/1996 | Allen . |
| 5,526,612 | 6/1996 | Wade . |
| 5,535,554 | 7/1996 | Harris, Jr. . |
| 5,535,970 | 7/1996 | Gobbi . |
| 5,548,931 | 8/1996 | Bryant . |
| 5,555,680 | 9/1996 | Sweers . |
| 5,557,891 | 9/1996 | Albracht . |
| 5,566,513 | 10/1996 | Herren . |
| 5,617,678 | 4/1997 | Morandin et al. . |
| 5,622,341 | 4/1997 | Stana . |

*Primary Examiner*—Lanna Mai

*Attorney, Agent, or Firm*—Edgar A. Zarins; Malcolm L. Sutherland

[57] ABSTRACT

A mounting clip for maintaining optimum positioning between a gutter and gutter cover or deflector designed to prevent debris from entering the gutter while directing rainwater into the gutter. In addition to maintaining proper positioning between the components, the gutter cover mounting clips substantially expedite installation of the system. The mounting clip includes an outer clip member into prevent separation of the cover from the gutter and a nesting inner clip member to maintain a proper gap between the cover and the gutter. An edge of the gutter is positionally captured between cooperating second ends of the inner and outer clip members. While expediting installation of the gutter cover at an optimum position relative to the gutter, the clips are positioned substantially inwardly so as to be concealed from ground view creating a clear installation.

9 Claims, 2 Drawing Sheets

GUTTER COVER MOUNTING CLIPS

BACKGROUND OF THE INVENTION

I. Field of the Invention

This invention relates to systems for preventing debris from entering a gutter and, in particular, to a mounting clip for maintaining optimum positioning of a gutter cover over the gutter while facilitating ease of installation of the gutter cover relative to the gutter of a home or other building.

II. Description of the Prior Art

Increasingly, homeowners have insisted upon installation of gutters to direct rainwater and other runoff from the roof to downspouts rather than drip the water over the edge of the roof. By controlling the flow of water it can be directed away from the building to prevent erosion and leakage into the foundation of the building. Gutters are typically installed along the roof line of a building to catch water runoff from the roof. Such gutters and downspouts are constructed of metal or vinyl in the shape of an open trough.

In addition to water, such open gutters can accommodate debris such as leaves and pine needles which cannot only fall directly into the gutter but can also be carried into the gutter by the runoff from the roof. An accumulation of such debris can retard the free flow of water through the gutter which results in standing water that may be damaging to the gutter over time. In order to reduce or prevent the debris from entering the gutter, various covers or screens for the gutter have been developed. Such devices range from simple screens positioned on top of the gutter to deflectors which direct the flow of water into the gutter with as little debris as possible. Although such covers may be formed as part of the gutter, it is preferable to retrofit the gutter system with a cover because of the large number of existing gutter systems. Accordingly, various brackets or similar means have been developed to secure the gutter cover to the building and/or gutter. However, many of the prior known attachment means have added considerably to the installation of the gutter cover system.

One of the more reliable gutter cover systems is shown in U.S. Pat. No. 4,404,775 which discloses a cover adapted to be positioned over a gutter to direct water into the gutter trough while debris such as leaves are ejected outside of the gutter. The device includes a curved nose which directs water through a gap or opening between the device and the gutter. Any mounting brackets should properly position the cover relative to the gutter in order to maximize the flow of water into the gutter while minimizing debris which may pass through the gap. Optimizing this gap and the positioning of the front nose of the cover can be a time consuming aspect of installation of the gutter cover system.

SUMMARY OF THE PRESENT INVENTION

The present invention overcomes the disadvantages of the prior known mounting assemblies for gutter systems by providing convenient to use mounting clips which maintain optimum positioning of the gutter cover over the gutter to maximize the flow of water into the gutter while preventing debris from entering the gutter.

During installation of a gutter cover on a gutter system the installer must balance proper positioning of the gutter cover relative to the gutter against the speed of installation which dictates the number of completed systems during any week, month or season. The mounting clip of the present invention facilitates installation of the cover in the proper position, most importantly properly positioning the nose of the gutter cover relative to a front portion of the gutter, allowing the installer to maximize the number of installations during any given period.

The mounting clip of the present invention comprises an outer clip member which prevents separation of the gutter cover relative to the gutter and a nesting inner clip member which maintains proper spacing between the components. A plurality of the mounting clips are employed at predetermined intervals along the gutter system to support the gutter cover in a proper position over the gutter. The inner clip member nests within the outer clip member to positionally capture a portion of the gutter between cooperating first ends of the mounting clip and positionally capture a portion of the gutter cover between second ends of the mounting clip. The dimensions of the inner and outer clip members determine the spacing between the cover and gutter since the mounting clip is configured to capture the gutter and cover in a precise position. These dimensions and configuration facilitate proper yet expeditious installation of the gutter cover relative to the gutter.

The outer clip member includes a first end with an inwardly disposed flange adapted to fit beneath a lip of the gutter. The inner clip member includes a first end with a groove to receive the gutter lip and the flange of the outer clip member whereby the gutter lip is captured between the inner and outer clip members.

The outer clip member includes a second end with an inwardly disposed channel adapted to receive an edge of the gutter cover. The inner clip member includes a second end with an outwardly disposed flange adapted to be received within the channel of the outer clip member whereby the edge of the gutter cover is captured between the inner and outer clip members. As a result, the inner clip member is disposed or nests between the first and second ends of the outer clip member.

Other objects, features and advantages of the invention will be apparent from the following detailed description taken in connection with the accompanying drawings.

BRIEF DESCRIPTION OF THE DRAWINGS

The present invention will be more fully understood by reference to the following detailed description of a preferred embodiment of the present invention when read in conjunction with the accompanying drawing, in which like reference characters refer to like parts throughout the view and in which.

DETAILED DESCRIPTION OF A PREFERRED EMBODIMENT OF THE PRESENT INVENTION

Figure 1:
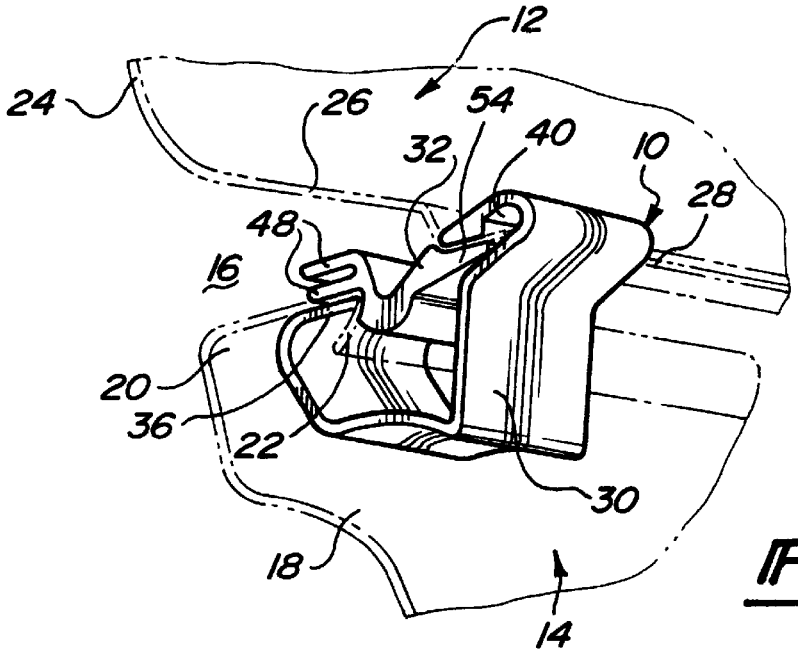
FIG. 1 is a perspective view of a mounting clip embodying the present invention and securing a gutter cover to a gutter system.
Figure 2:
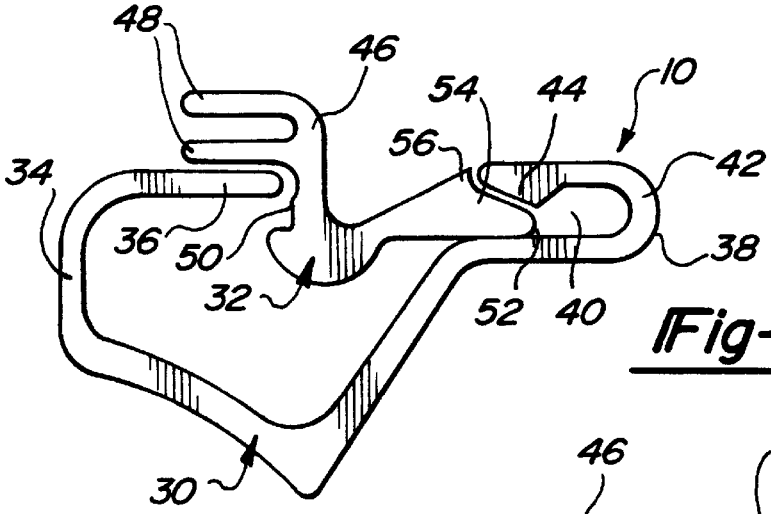
FIG. 2 is a side view thereof.
Figure 3:
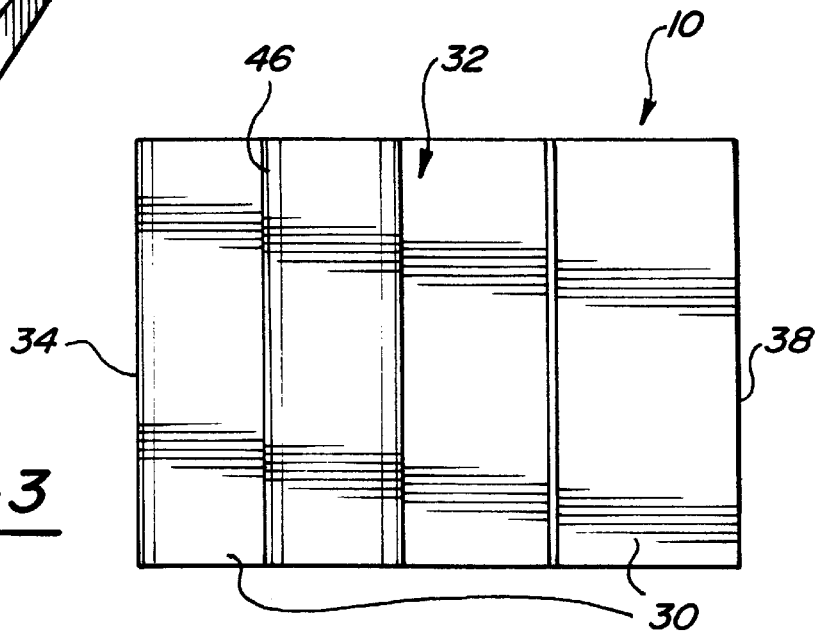
FIG. 3 is a top plan view thereof.
Figure 4:
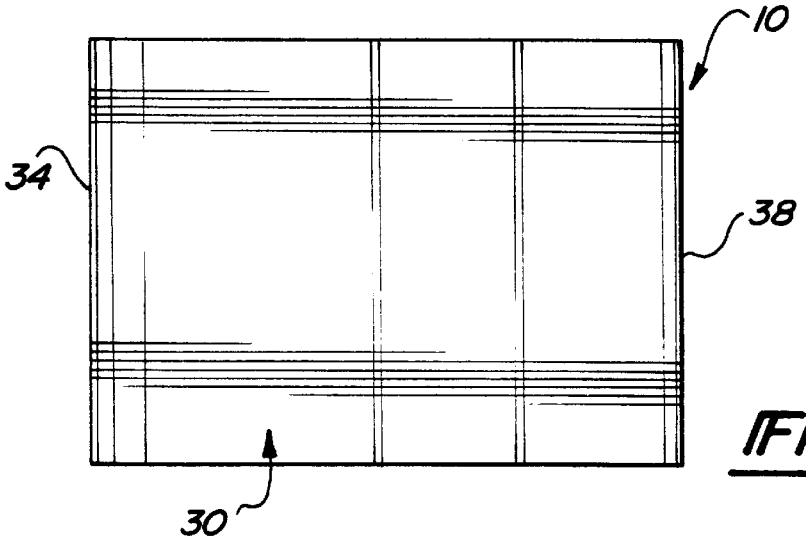
FIG. 4 is a bottom plan view thereof.
Figure 5:
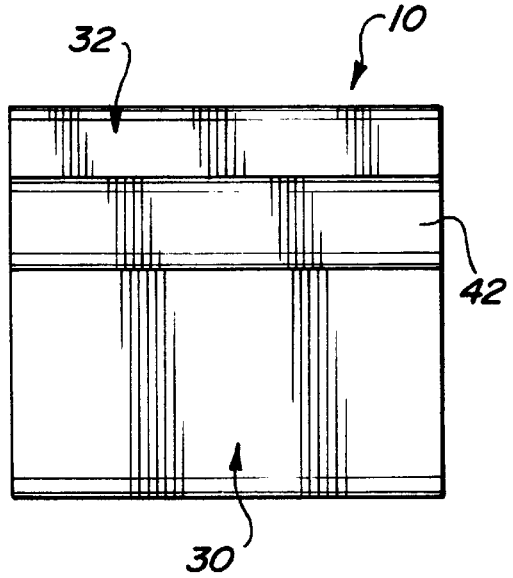
FIG. 5 is an end view from the interior.
Figure 6:
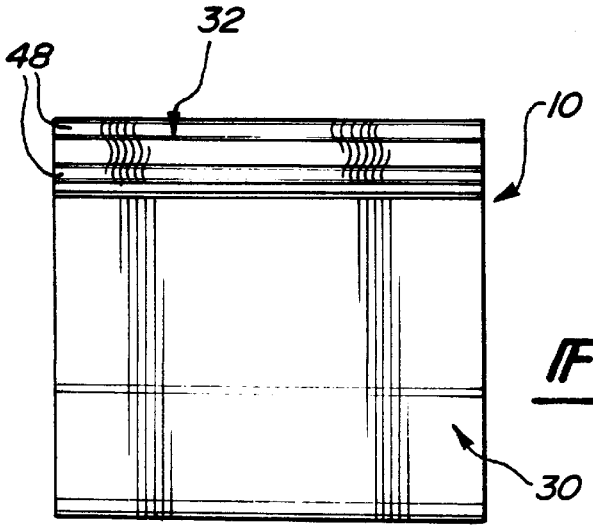
FIG. 6 is an end view from the exterior.

Referring first to FIG. 1, there is shown a mounting clip 10 for use in the installation of a gutter cover 12 relative to a gutter 14 of a building to ensure proper relative positioning while simplifying installation. In a typical installation, the gutter 14 is mounted to a building at the roof edge to accumulate water runoff from the roof and direct the water to downspouts. In order to prevent debris such as leaves, pine needles, twigs, etc. from entering the gutter and possibly block the proper flow of water through the gutter, various gutter cover systems have been developed. Such gutter covers are designed to prevent debris from entering the gutter either directly or in conjunction with water flowing into the gutter. Many of the covers have drawbacks but one of the more advantageous gutter covers uses the surface adhesion properties of water to direct runoff into the gutter while expelling debris. In such a system, an arcuate nose of the cover is positioned over the front portion of the gutter such that water follows the arcuate surface into the gutter while debris is jettisoned over the front of the gutter cover. In order to prevent debris from directly falling or blowing into the gutter, the gutter cover should be positioned with an optimum gap above the gutter. The mounting clip 10 optimizes the gap 16 between the gutter 14 and cover 12 while supporting the cover 12. In a preferred embodiment, a plurality of mounting clips 10 are employed at predetermined intervals to provide proper support.

For purposes of illustration, the present invention will be described and shown in connection with a conventional gutter configuration 14 and cover configuration 12. However, it should be understood that the principles of the present invention can be employed with various gutter and cover systems without departing from the scope of the invention. As shown in FIG. 1, the gutter 14 includes a front wall 18 with an outer bead 20 formed by bending the front wall 18 inwardly and creating a lip 22. The gutter cover 12 includes an arcuate nose 24 having an inwardly disposed wall 26. At the inner end of the wall 26 is a shoulder 28 formed by bending the wall 26.

The mounting clip 10 includes an outer clip member 30 which cooperates with both the gutter 14 and gutter cover 12 to prevent expansion of the gap 16 therebetween and an inner clip member 32 received within the outer clip member 30. The inner clip member 32 cooperates with both the gutter cover 12 and gutter 14 to prevent reduction in the gap 16 by maintaining the spacing between the cover 12 and gutter 14. At the junctures between the outer member 30 and the inner member 32, portions of the gutter cover 12 and gutter 14 are captured to maintain connection with the mounting clip 10. In a typical installation, a plurality of the mounting clips 10 would be used at predetermined maximum intervals to support the gutter cover 12 over the gutter 14.

The outer clip member 30 has a general C-shaped configuration adapted to nestably receive the inner clip member 32. The outer clip 30 includes a first end 34 with an inwardly disposed flange 36. The flange 36 is adapted to be received within the lip 22 of the gutter 14 and therefore, upon installation, is disposed horizontally beneath the horizontal surface of the gutter bead 20. A second end 38 of the outer clip member 30 has an inwardly disposed channel 40 which opposes the flange 36 of the first end 34. The channel 40 is formed by creating a U-shaped bend 42 in the end section of the outer clip member 30. In a preferred embodiment of the outer clip 30, a bead 44 is formed on the wall of the channel 40 in order to more securely engage the gutter cover 12 as will be subsequently described.

The inner clip member 32 has a general Z-shaped configuration with a first end 46 having a pair of outwardly disposed parallel flanges 48 and a groove 50 formed beneath the flanges 48. The flanges 48 facilitate insertion and, if necessary, removal of the inner clip member 32. Upon insertion of the inner clip member 32 into the outer clip member 30, the flange 36 of the outer clip 30 along with a portion of the gutter 14, is received within the groove 50 of the inner clip 32 thereby capturing the gutter portion between the first ends of the inner and outer clip members.

The inner clip member 32 also includes a second end 52 having a flange 54 adapted to be received within the channel 40 of the outer clip member 30. The flange 54 is preferably specially configured to be matingly received within the channel 40 and in particular includes a cusp 56 to allow the flange 54 to fittingly cooperate with the bead 44. The flange 54 of the inner clip member 32 and the channel 40 of the outer clip member 30 cooperate to capture a portion of the gutter cover 12. In a preferred embodiment of the present invention, the flange 54 of the inner clip member 32 and the channel 40 of the outer clip member 30 are configured to capture the shoulder 28 of the gutter cover 12.

The mounting clip 10 facilitates the efficient and optimum installation of the gutter cover 12 relative to the gutter 14. As has been noted, in the typical installation, a plurality of mounting clips 10 would be employed along the installation to provide the necessary support. With the gutter 14 attached to the building proximate the roof line, the gutter cover 12 is positioned over the gutter 14. In many gutter covers 12, the inward edge of the cover 12 is secured to the building either along the roof or eaves such that water flows over the top of the cover 12. The outer edge of the cover 12 is secured to the gutter 10 using the mounting clips 10. The outer clip member 30 is attached to the gutter 14 by inserting the flange 36 beneath the lip 22 of the gutter 14. The edge or shoulder 28 of the gutter cover 12 is inserted into the channel 40 of the outer clip member 30 which pulls the cover 12 towards the forward wall 18 of the gutter 14 to form the maximum gap 16. This tension holds the gutter cover 12 within the mounting clip 10. While the outer clip member 30 maintains the maximum gap 16 between the cover 12 and gutter 14, insertion of the inner clip member 32 will prevent a reduction in the gap 16 which maintains the gutter cover 12 within the mounting clip 10. Preferably using an appropriate tool inserted between the flanges 48 of the inner clip member 32, the flange 54 is inserted into the channel 40. Application of downward pressure on the first end 46 of the inner clip member 32 allows the groove 50 to snap over the gutter lip 22 and the inwardly disposed flange 36 of the outer clip member 30. As a result, the gutter cover 12 is captured between the second ends of the inner and outer clip members and the gutter 14 is captured between the first ends of the inner and outer clip members. Accordingly, the outer clip member 30 prevents separation of the gutter cover 12 relative to the gutter 14 while the inner clip member 32 maintains an optimum gap 16 between the gutter cover 12 and gutter 14. Most importantly, the clip 10 properly positions the cover 12 over the gutter 14 by ensuring that the arcuate portion 24 of the cover 12 is properly positioned relative to the front position of the gutter 14.

The foregoing detailed description has been given for clearness of understanding only and no unnecessary limitations should be understood therefrom as some modifications will be obvious to those skilled in the art without departing from the scope and spirit of the appended claims.

What is claimed is:

1. A mounting clip for securing a gutter cover relative to a gutter of a building, said mounting clip comprising:

an outer clip member having a first end engageable with the gutter and a second end engageable with the gutter cover to prevent separation of the gutter cover relative to the gutter, said first end of said outer clip member includes an inwardly disposed flange and said second end of said outer clip member includes an inwardly disposed transverse channel; and an inner clip member having a first end engageable with the gutter and a second end engageable with the gutter cover to maintain a minimum separation between the gutter cover and gutter, said inner clip member removably received within said outer clip member, said first end of said inner clip member includes a transverse groove for receiving said flange of said outer clip member while capturing a portion of the gutter between said flange and said inner clip member and said second end of said inner clip member includes an outwardly disposed flange removably received within said channel of said outer clip member while capturing a portion of the gutter cover within said channel.

2. The mounting clip as defined in claim 1 wherein said first end of said inner clip member further comprises a pair of parallel flanges adapted to receive an insertion tool for removably inserting said inner clip member within said outer clip member.

3. The mounting clip as defined in claim 1 wherein said inwardly disposed channel of said outer clip member is formed by a U-shaped portion of said second end of said outer clip member.

4. The mounting clip as defined in claim 1 wherein said transverse channel of said outer clip member and said flange of said inner clip member include cooperating transverse beads adapted to cooperatingly capture the gutter cover portion therebetween.

5. A gutter system for controlling the flow of water from a roof of a building, the system comprising:

a gutter mounted to the building proximate the roof for capturing and directing the flow of water; said gutter having a top opening;

a gutter cover mounted proximate said gutter at least partially across said top opening of said gutter; and a plurality of clips for securing an outer portion of said gutter cover relative to said gutter to maintain a predetermined separation between said cover and gutter, said mounting clips including:

an outer clip member having a first end engaging with said gutter and a second end engaging with said gutter cover, said outer clip member preventing separation of said gutter cover relative to said gutter; and an inner clip member having a first end engaging with said gutter and a second end engaging with said gutter cover, said inner clip member received within said outer clip member to maintain said predetermined separation between said gutter cover and said gutter.

6. The system as defined in claim 5 wherein said first end of said outer clip member includes an inwardly disposed flange and said first end of said inner clip member includes a transverse groove which receives said flange of said outer clip member and capturing a portion of said gutter between said flange and said inner clip member.

7. The system as defined in claim 6 wherein said second end of said outer clip member includes an inwardly disposed transverse channel and said second end of said inner clip member includes an outwardly disposed flange removably received within said channel of said outer clip member and capturing a portion of said gutter cover within said channel.

8. The system as defined in claim 2 wherein said first end of said inner clip member further comprises a pair of parallel flanges adapted to receive an insertion tool for removably inserting said inner clip member within said outer clip member.

9. The system as defined in claim 8 wherein said transverse channel of said outer clip member and said flange of said inner clip member include cooperating transverse beads.

* * * * *